US006467494B1

(12) United States Patent
Kolb et al.

(10) Patent No.: US 6,467,494 B1
(45) Date of Patent: Oct. 22, 2002

(54) ARRANGEMENT IN A VACUUM SEWER SYSTEM FOR PREVENTING WATER ENTERING A PNEUMATIC CONTROLLER THROUGH A BREATHER LINE

(75) Inventors: Claus Kolb, Allison Park; Markus Roediger, Sewickley, both of PA (US); Reinhold Betz, Tostedt (DE)

(73) Assignee: Roediger Vakuum- und Haustechnik GmbH, Hanau (DE)

( * ) Notice: Subject to any disclaimer, the term of this patent is extended or adjusted under 35 U.S.C. 154(b) by 0 days.

(21) Appl. No.: 09/640,635

(22) Filed: Aug. 17, 2000

(30) Foreign Application Priority Data

Aug. 18, 1999 (DE) ..... 199 38 590
May 30, 2000 (DE) ..... 100 26 843

(51) Int. Cl.[7] ..... F04F 3/00
(52) U.S. Cl. ..... 137/12; 137/205; 137/907

(58) Field of Search ..... 137/12, 205, 907

(56) References Cited

U.S. PATENT DOCUMENTS 5,570,715 A * 11/1996 Featheringill et al. ..... 137/205
5,657,784 A * 8/1997 Martens ..... 137/907 X

* cited by examiner

*Primary Examiner*—Gerald A. Michalsky
(74) *Attorney, Agent, or Firm*—Ansel M. Schwartz

(57) ABSTRACT

Arrangement and method for the prevention of water entering a pneumatic controller of a vacuum sewer system through a breather line. The proposed pneumatic controller is a non-bleeding controller preventing continuous flow of air from the breather line through the controller. The volume of breather air entering the controller during an evacuation cycle is smaller than the volume of a water trap provided in the breather line. The water trap removes water from the breather air before it enters the controller.

34 Claims, 3 Drawing Sheets

ARRANGEMENT IN A VACUUM SEWER SYSTEM FOR PREVENTING WATER ENTERING A PNEUMATIC CONTROLLER THROUGH A BREATHER LINE

FIELD OF THE INVENTION

The present invention is related to vacuum sewer systems. More specifically it is related to an arrangement for the supply of atmospheric air to a pneumatic controller of an interface valve, the arrangement preventing water entering the pneumatic controller.

BACKGROUND OF THE INVENTION

Vacuum sewer systems are an alternative to conventional gravity sewer systems. Vacuum sewer systems are used where conventional systems are expensive due to flat terrain, low housing density, difficult ground conditions, high ground water table, or crossing of water protection areas.

Main components of a vacuum sewer system are:

Collection chambers that are installed in yards or streets and include pneumatic interface valves and controllers; vacuum sewers with systematically arranged high and low points; and a vacuum source, i.e. a vacuum station including vacuum tanks, vacuum pumps and sewage pumps. Fundamentals of vacuum sewer systems are described e.g. in U.S. Pat. No. 3,730,884.

Wastewater flows from houses to the collection chambers. The wastewater is collected in a sump of the collection chamber. A collection chamber also includes an interface valve unit consisting of an interface valve, a pneumatic controller and a sensor pipe. Wastewater that has collected in the sump hydro-statically generates an air pressure in the sensor pipe. This air pressure is transmitted to the controller. The controller opens the interface valve when a certain air pressure is transmitted from the sensor pipe. After wastewater evacuation and drop of sensor pressure, the controller closes the interface valve, but after an additional delay time permitting air admission after wastewater evacuation. The admitted atmospheric air drives the wastewater through the vacuum sewers towards the vacuum station.

A pneumatic controller for a vacuum sewer system was described in U.S. Pat. No. 5,657,784 (The following numerals refer to this U.S. patent). The pneumatic controller 10 includes a three-way valve 20. The three-way valve 20 either transmits vacuum from a vacuum source to the interface valve to open it, or atmospheric pressure from the environment to close it. The controller includes a control chamber 56 that is evacuated through a control valve 22 when the sensor pressure is sufficient to move a sensor diaphragm 16 and open the control valve 22. The control chamber 56 is continuously connected to the atmosphere through an adjustable nozzle 64 and a filter element 68. When the control chamber 56 is evacuated, a control diaphragm 72 is pulled into the control chamber 56 and moves the three-way valve 20 so that it transmits vacuum from the vacuum source to the interface valve thus opening the interface valve. When the wastewater has been evacuated, the sensor pressure drops and the sensor diaphragm 16 returns to its original position. It returns the control valve 22 that shuts the control chamber 56 from the vacuum source. Atmospheric air enters slowly through nozzle 64 into control chamber 56 gradually raising the pressure in the control chamber 56. The control diaphragm 72 and the three-way valve 20 return to their original positions. Atmospheric air is transmitted through the three-way valve 20 to the interface valve and the interface valve is closed. An evacuation cycle is finished.

Atmospheric air can be supplied to the pneumatic controller and the interface valve through an open lid of the collection chamber. However, when the collection chamber is located at a place where surface water could enter the chamber, the chamber cover must be sealed and atmospheric air supplied through a breather line. The breather line can take atmospheric air directly from the environment, e.g. through an external breather tube extending to a level above the maximum flood level, as shown e.g. in U.S. Pat. No. 4,373,838. Alternatively, the breather line can take atmospheric air from the top of the collection chamber sump. The sump is connected to the atmosphere through a vent stack on the gravity drain between the house and the collection chamber. The vent stack also extends to a level above the maximum flood level.

The controller as described in U.S. Pat. No. 5,657,784 has the disadvantage that air bleeds through the controller (The following numerals refer to this U.S. patent). Atmospheric air continuously flows through the controller while the control valve 22 is open. Atmospheric air enters the control chamber 56 through nozzle 64 while air is simultaneously evacuated from the control chamber 56 to the vacuum source. In addition, a direct connection between the atmosphere and the vacuum source is open while the three-way valve 20 switches from one to another position. In the worst case, the controller bleeds for a long time. This happens when the sensor pressure is sufficient to open the control valve 22, but the vacuum strength is insufficient to move the three-way valve 20 and open the interface valve.

Bleeding controllers have the great disadvantage that a large air volume flows through the controllers and their nozzle. When the air is warm and humid, and the controller is cooler than the air, water condensation occurs in the controller. The more air flows through the controller, the more water condenses. Water in pneumatic controllers causes them to fail. The danger of water condensation is particularly great when atmospheric air is taken from the sump because the wastewater in the sump can be warm and the air in the sump becomes warm and humid. Failure of sump breathing controllers is very frequent.

An even greater problem with sump breathing controllers can be caused when wastewater aspiration occurs. When the vacuum strength is insufficient to open the interface valve and evacuate the wastewater, the water level in the sump rises further. When the controller bleeds, the top of the sump is evacuated and the water level can rise until it reaches the sump breather line and is aspirated through the controller.

Entrance of water into the controller must be prevented to guarantee reliable operation of the controller. Water entering a breather line could be condensed water, ground water infiltrating into a leaking breather line or, in the worst case, it could be wastewater from the sump.

A sump breather arrangement was described in U.S. Pat. No. 4,691,731 by Grooms et al. This arrangement was unable to prevent wastewater from entering the controller, as discussed in detail in U.S. Pat. No. 5,570,715 by Featherington and Grooms.

Another sump breather arrangement was described in U.S. Pat. 5,570,715. The controller is a bleeding controller. When control valve 88 is opened by sensor pressure moving sensor diaphragm 86, atmospheric air is sucked from connection 102 through bores 104 and 106, chamber 79, control valve 88, tubes 120, chamber 82 and connection 96 to the vacuum source. It has the same disadvantage as all other controllers of the prior art that it provides an open connection through the controller between the atmosphere and the vacuum source when the controller is activated by sufficient sensor pressure. Bleeding leads to evacuation of air from the sump into the controller.

To avoid aspiration of wastewater from the sump, the arrangement according to U.S. Pat. No. 5,570,715 also includes a float valve 250 closing the entrance from the sump to the breather line when the wastewater level in the sump rises to a level close to the entrance into the breather line. A problem with this arrangement is that the float valve can be made inoperable by solids or grease floating on the wastewater in the sump. If the float valve does not completely seal the breather line, wastewater enters the controller. Another disadvantage of the arrangement is that the air in the top of the sump is evacuated through the bleeding controller thus further raising the water level in the sump when the vacuum strength is insufficient to open the interface valve. Another problem is that considerable quantities of condensed water could accumulate in the controller during ongoing bleeding.

OBJECTS OF THE INVENTION

Main object of the present invention is to improve a pneumatic controller, as described in U.S. Pat. No. 5,657,784, such that entrance of wastewater through a sump breather line is safely prevented. The improved controller should non-bleeding under all circumstances. The controller should have no open connection through the controller between the breather line and the vacuum source. The improved controller should be capable to be connected to an open sump breather line without the danger that wastewater from the sump enters the controller, and without the need for a float valve in the sump.

The improved controller should need a very small volume of breather air for operation in order to reduce the danger of condensation, whether it is connected to a sump breather or an external breather line.

The improved controller should also be compact, easy to manufacture, reliable and inexpensive.

Another object of the present invention is to provide an arrangement within a breather line for the collection and removal of water, such as condensed water, infiltration water or wastewater, from the breather line thus preventing water from being conveyed through the breather line to the controller. This arrangement should be reliable, simple and inexpensive.

SUMMARY OF THE INVENTION

The main object of the invention is achieved by an improved controller including means preventing, under all conditions and circumstances, an open connection from the breather line through the controller to the vacuum source. The means preventing such bleeding include a control valve either closing a connection between a control chamber and the breather line or closing a connection between the control chamber and the vacuum source, but under no circumstances opening a connection between the breather line and the vacuum source.

More specifically, the improved controller includes in a single body a control valve, a control chamber, a control diaphragm and a three-way valve, the control chamber having connections to the vacuum source and to the atmosphere, but either shutting the connection to the vacuum source or the connection to the atmosphere. The control chamber is either evacuated (when the controller is activated by sufficient sensor pressure) or aerated (after wastewater has been evacuated and the sensor pressure has dropped), but simultaneous flow of air in and out of the control chamber cannot occur.

Only a small volume of air flows through the breather line during an evacuation cycle to the controller and interface. The air volume flowing into the control chamber is only a fraction of the volume of control chamber, the fraction depending on the vacuum strength. The air volume flowing to the interface valve is a fraction of the volume of the actuator of the interface valve. These volumes are only a very small fraction of the volume of air that is entrapped in the top of a sealed sump. The wastewater level in the sump rises only by a marginal amount and cannot reach the breather line. Entrance of wastewater into the breather line is thus prevented. The volume of water that could be condensed in the controller is greatly reduced.

Air from the sump does not enter the control chamber before the wastewater has been evacuated. Then the wastewater level in the sump has dropped and fresh atmospheric air has entered the sump. This fresh atmospheric air is less warm and humid than the air that had been in the top of the sump before the wastewater was evacuated.

A latching means is also included in the controller. This latching means can be a magnet attached to the controller body and a steel plate attached to the control diaphragm, or vice versa. A certain vacuum strength in the control chamber that is required for proper evacuation of wastewater from the sump is necessary to overcome the latching force and move the control diaphragm into the control chamber. The latching means could also be mechanical mechanisms, such as a spring loaded catch element.

Open pressure communication between the sump and the control diaphragm has an important advantage. When rising wastewater in the sump compresses the air that is entrapped in the top of the sump, an increased pressure (above atmospheric pressure) is transmitted to the control diaphragm exerting an increased force pushing the diaphragm into the control chamber. As a result, this increased pressure helps the vacuum pressure in the control chamber to overcome the latching force. A smaller vacuum strength is sufficient to pull the diaphragm into the control chamber and thus switching the three-way valve and opening the interface valve. The interface valve is thus opened at a reduced vacuum strength. The vacuum strength required for proper evacuation of the wastewater from the sump is also reduced because the elevated water level in the sump adds an increased hydrostatic pushing force to the pulling vacuum force from the vacuum source. Operability of the vacuum sewer system is thus improved.

An adjustable nozzle is provided in a connection between the breather line and the control chamber. The air flow through the breather line into the control chamber is restricted by the nozzle thus slowing the rise of the pressure in the control chamber. Closing of the interface valve is thus adjustably delayed permitting air evacuation through the sump after wastewater evacuation. The ratio of the air/wastewater volumes can be increased by reducing the orifice of the nozzle.

The nozzle is protected by a filter element that is provided between the breather line and the nozzle. This filter element retains dirt that could clog the small nozzle orifice.

According to the present invention, the other object is achieved by providing an arrangement preventing entrance of water into a pneumatic controller of an interface valve through a breather line including:

A first chamber having a bottom, a cover and a wall, a first connection to the breather line for intake of atmospheric air, a second connection to the controller for transmitting atmospheric air to the controller, and a third connection to a vacuum source; and a float body within the first chamber arranged such that the float body is closing and sealing the third connection while few water has collected in the first chamber, and is opening the third connection as a result of a buoyancy force acting on the float body when more water has collected in the first chamber.

In other words, the first chamber is arranged in a breather line and water entering the breather line or being condensed within the breather line is separated and collected in the chamber. As long as no or little water is collected, the breather connection is open between the atmosphere and the controller. While water is collected in the first chamber, the water raises a float body thus opening the third connection through which collected water is sucked into the vacuum sewer system. The water level in the third chamber is thus limited and can never reach the second connection to the controller. After the water has been evacuated the float body is sucked towards the third connection thus closing it. The third chamber acts as a water trap that is automatically evacuated.

As an additional feature, the float body closes and seals the second connection when the float body is further lifted by buoyancy force, whereby the float body first opens the third connection, and thereafter closes the second connection, as the float body is lifted. This is to provide an additional safety against water entering the controller through the second connection. This additional safety could be needed for the case that the strength of the vacuum source would be insufficient for fast evacuation of the chamber, e.g. due to a failure of the vacuum system, or if more water would enter the chamber than can be evacuated from the chamber.

The first connection to the atmosphere is preferably located in the wall near the cover so that the float body cannot close the connection to the atmosphere. In this way it is guaranteed that the water is rapidly driven through the third connection by the difference between atmospheric pressure and vacuum pressure. In addition it is guaranteed that water is driven from the breather line into the chamber. This is particularly important if the breather line has a low point that could become water logged thus reducing the pressure that is transmitted to the controller.

The first chamber has preferably a fourth connection to the interface valve transmitting atmospheric pressure to the interface valve. A typical interface valve has two connections, one connection transmitting vacuum or atmospheric pressure from the controller into the interface valve's actuation volume, e.g. a bellow, the other connection transmitting atmospheric pressure as reference pressure to a volume in the valve casing. While the float body can close the second connection to the controller, the fourth connection remains always open to guarantee that the interface valve can be closed at any time. Preferably the fourth connection is, like the first connection, penetrating the wall of the chamber near its cover so that it is always open, but cannot be reached by the water level.

Alternatively, the second connection could be connected to the controller and the interface valve, i.e. a tube to the interface valve branches off from a tube between the first chamber and the controller.

The third connection is provided with a peripheral seal, such as a lip seal. Sealing is supported by vacuum force pulling the float body towards the third connection and against the seal.

While it would be obvious to locate the third connection at the bottom of the first chamber, it is unexpectedly better if the third connection penetrates the wall of the chamber. A much smaller buoyancy force is required to open the third connection because the gravity of the float body and the suction force exerted on the float body from the third connection have an angle of approximately 90 degrees. The third connection is thus opened when a relatively small volume of wastewater has collected. The volumes of the float body and of the third chamber can be kept small.

It is further proposed to provide the first chamber with a sloped bottom, sloped towards the third connection. After water has been evacuated from the first chamber, the float body is driven by its gravity towards the third connection. It slides or rolls on the bottom towards the third connection until it closes and seals the third connection.

The float body is preferably a sphere with a diameter D. The sphere rolls on a sloped bottom of the first chamber towards the third connection and is sucked towards the third connection so that it seals the third connection.

The first chamber has preferably a cylindrical shape. Its height should be less than 2*D and its internal diameter smaller than 1.5*D. The distances of the first and fourth connections from the cover of the first chamber should be smaller than 0.5*D so that these connections cannot be closed by the floating sphere.

As a further improvement of the arrangement according to the invention it is proposed to provide a second chamber with a bottom, wall and cover. The second chamber is connected with the first chamber through the third connection, to the controller through a fifth connection, and to the vacuum source through a sixth connection. The sixth connection should be located at the bottom of the second chamber so that water drains through the sixth connection towards the vacuum source. Vacuum pressure is transmitted through the second chamber to the controller and to the third connection of the first chamber. The second chamber serves as a surge volume preventing wastewater from entering the fifth connection to the controller. Wastewater could be driven through the sixth connection by a pressure surge in the vacuum system. The controller is supplied with vacuum through the fifth connection, or in other words, air is evacuated from the controller through the fifth connection. The fifth connection is preferably penetrating the wall of the second chamber near its cover in order to prevent water from entering the fifth connection. As an additional safety means a check valve can be installed in a conduit between the sixth connection and the vacuum source. This check valve would prevent the pressure surge and wastewater from entering the second chamber while permitting air and water to be evacuated from the second chamber to the vacuum source.

The first and the second chamber can be located in a single housing such that the bottom of the first chamber is the cover of the second chamber. The housing and both chambers preferably have a cylindrical shape. The housing can be made inexpensively of a PVC pipe, forming the walls of both chambers, and of PVC caps forming the cover of the first chamber and the bottom of the second chamber. The pipe could be transparent. The bottom of the first chamber and the cover of the second chamber can be formed by a circular or elliptical plate separating the chambers. While the upper cap should be removable to permit removal of the float body, the lower cap can be fixed to the pipe, e.g. by solvent welding. An O-ring in a groove of the upper cap seals the spacing between the cap and the pipe.

The volume of the first chamber should be larger than the volume of air entering through the breather line during an evacuation cycle. The air rests in the first chamber and vapor can be condensed before the air enters the controller. This is particularly beneficial when the valve chamber is cooler than the atmospheric air entering the first chamber through the breather line.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
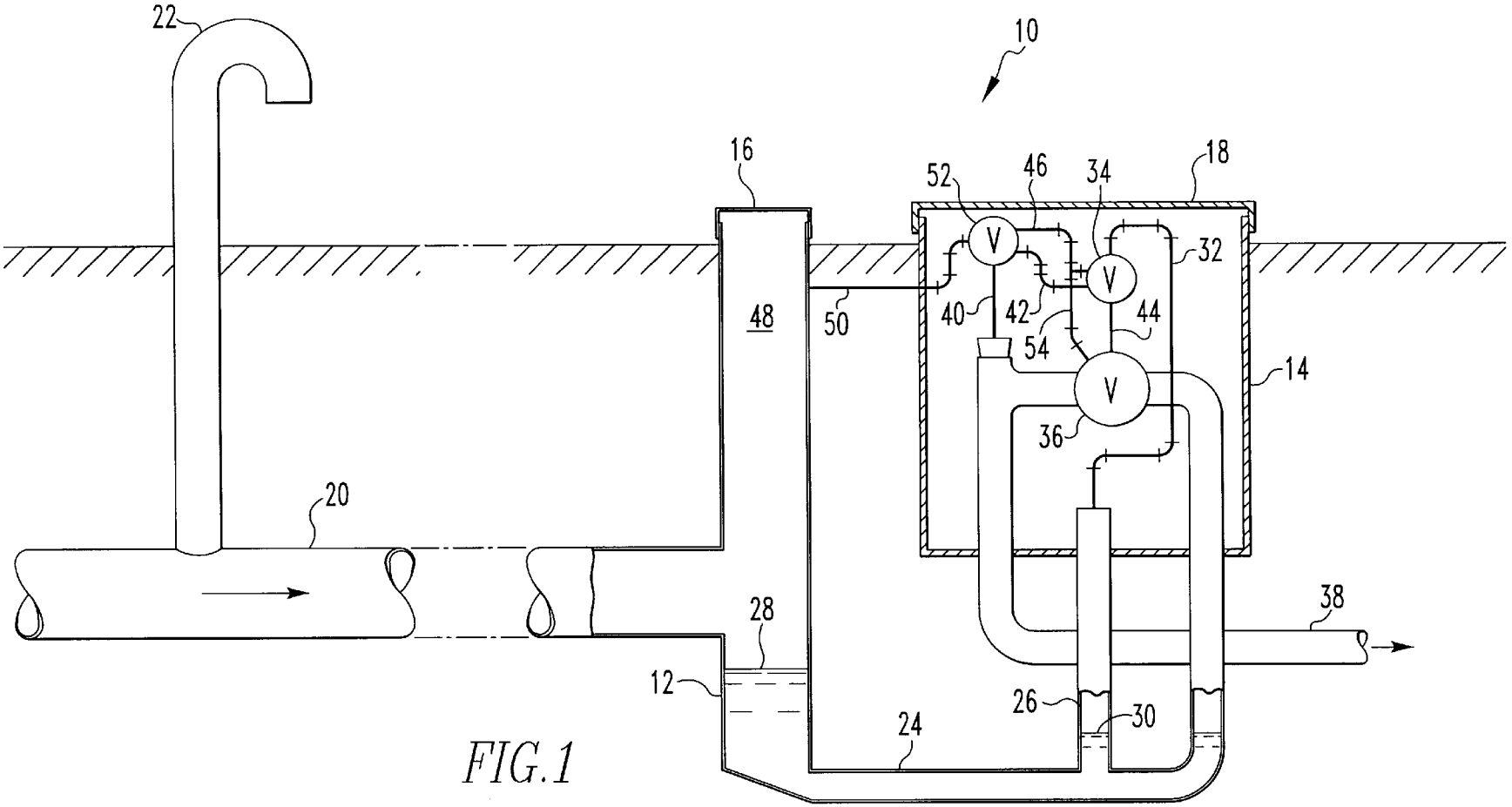
FIG. 1 shows a schematic sketch of a water tight collection chamber with a sump breather arrangement.

Referring now to the drawings wherein like reference numerals refer to similar or identical parts throughout the several views, and more specifically to FIG. 1 thereof, there is shown a collection chamber 10. The collection chamber 10 includes a sump 12 and a valve chamber 14. The sump has an airtight and watertight cover 16, and the valve chamber has an airtight and watertight cover 18.

Wastewater from a building (not shown) flows by gravity through a drainpipe 20 to the sump 12 and collects in the sump. The sump 12 is ventilated through a vent stack 22 so that atmospheric air pressure is transmitted to sump 12. Vent stack 22 is open at a level above the maximum flood level.

The sump is connected with a suction pipe 24 and is in communication with a sensor pipe 26. A water level 28 in sump 12 rises as wastewater enters the sump. Air that is entrapped in sensor pipe 26 is compressed by hydrostatic pressure. Its pressure is proportional to the difference between the sump water level 28 and the water level 30 in the sensor pipe. The air pressure in the sensor pipe 26, called sensor pressure, is transmitted through a tube 32 to a pneumatic controller 34. When a certain sensor pressure is reached, controller 34 is activated and opens a pneumatic interface valve 36 by transmitting vacuum pressure from a vacuum source (not shown) through a service pipe 38 and tubes 40, 42, 44 to the interface valve 36. Wastewater is evacuated from sump 12 through the suction pipe 24, the now open interface valve 36 and through the service pipe 38 towards the vacuum source. While the wastewater is evacuated, the water level 28 in sump 12 and the sensor pressure in sensor pipe 26 drop. When the sensor pressure transmitted to controller 34 has dropped below a certain level and after a certain adjustable delay time has passed, controller 34 shuts a connection between the tubes 42 and 44, and opens a connection between a tube 46 and a tube 44. Atmospheric air pressure is then transmitted from a top portion 48 of sump 12 through a sump breather line 50 and tubes 46 and 44 to the interface valve 36. Interface valve 36 shuts. During the delay time, air is admitted to the vacuum system through vent stack 22, drainpipe 20, sump 12, suction pipe 24, the still open interface valve 36 and service pipe 38.

If the vacuum strength transmitted from the vacuum source through tubes 40 and 42 to controller 34 is too low to guarantee proper evacuation of sump 12, controller 34 must not open interface valve 36. In this case, the water level 28 in sump 12 can rise above the controller activation level, and wastewater backup can occur in drainpipe 20. When the wastewater fills drainpipe 20, sump top 48 is separated from the atmosphere. The non-bleeding controller 34 does not let pass air from the sump top 48. The air in sump top 48 is entrapped and compressed. The air pressure in sump top 48 prevents the wastewater level 28 from rising to breather line 50. When the vacuum strength transmitted from the vacuum source has risen to a level sufficient for the operation of controller 34 and interface valve 36, a small volume of air flows from the sump top 48 through breather tube 46 to controller 34 and through breather tube 54 to interface valve 36. However, this volume is much smaller than the air volume entrapped in sump top 48. After evacuation of the wastewater from sump 12 through the open interface valve 36, air can flow from vent stack 22 through breather line 50 to controller 34. Another small air volume enters controller 34 during the delay time.

The air in sump top 48 is almost water saturated. Particularly if the wastewater in sump 12 is hot, the air is very humid, i.e. it contains much vapor. If the temperature in valve chamber 14 is lower than the temperature of the air in sump top 48, air entering through breather line 50 is cooled and water is condensed. To prevent condensed water from entering controller 34, a water trap 52 is arranged between sump breather line 50 and tube 46. Water and humidity that might enter breather line 50 is separated in water trap 52. Separated water is evacuated from water trap 52 through tube 40 towards the vacuum source. The water trap 52 prevents water from entering controller 34 through breather tube 46 and from entering interface valve 36 through another breather tube 54. Water trap 52 should be placed at a lower level than shown in FIG. 1, thus forming a low point, so that water can drain by gravity from breather tube 46 to water trap 52. The water trap 52 is connected with the service pipe 38 through tube 40. Alternatively the water trap 52 could be directly attached on service pipe 38.

Figure 2:
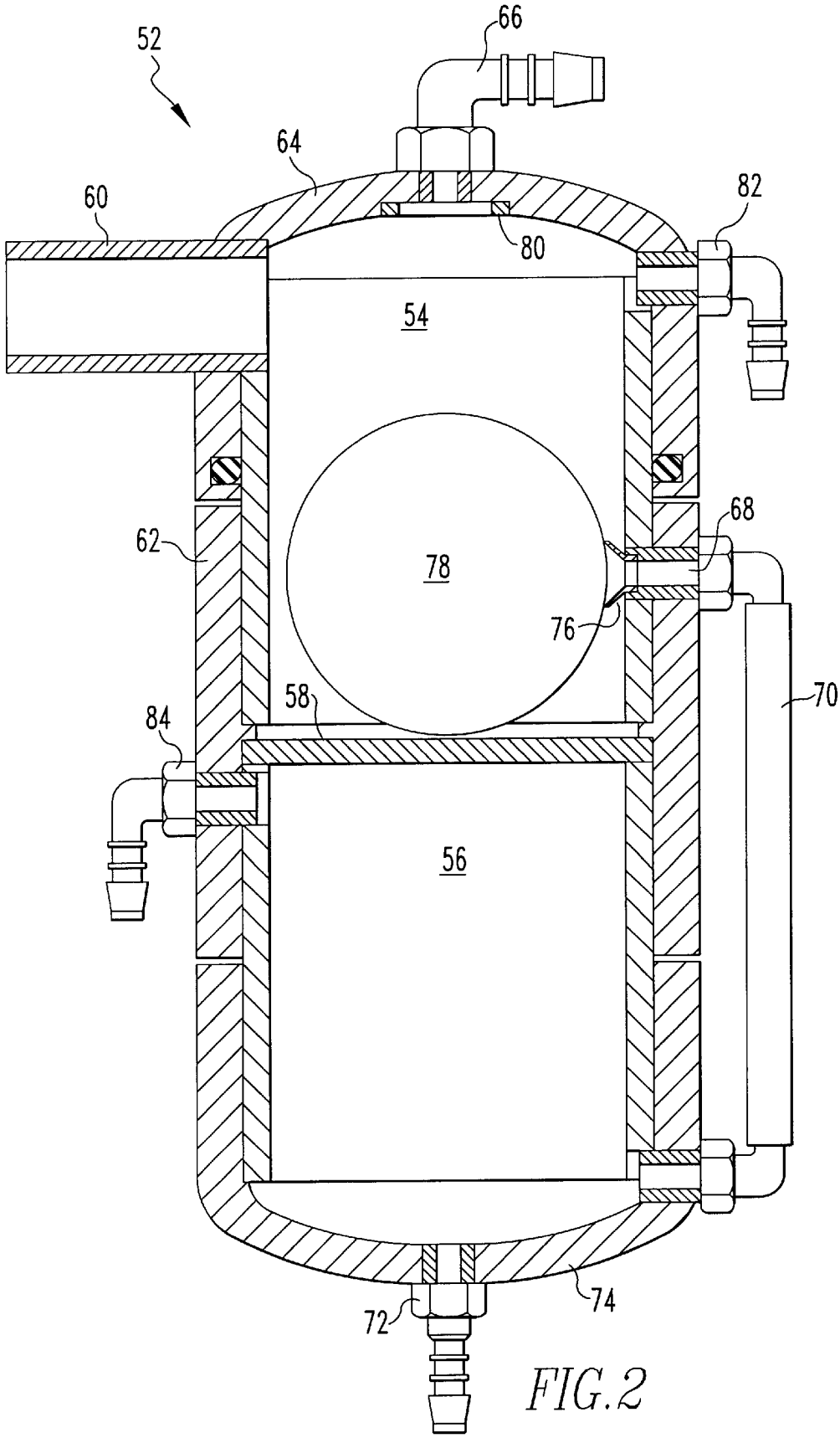
FIG. 2 shows a chamber for separation and removal of water, or a water trap, in sectional view.

FIG. 2 shows details of the water trap 52. Water trap 52 has a cylindrical shape and includes an upper first chamber 54 and a lower second chamber 56. A plate 58 separates the chambers. Plate 58 forms the bottom of the first chamber 54 and the cover of the second chamber 56.

A first connection 60 penetrates a wall 62 of the first chamber 54. Breather line 50 is attached to the first connection 60 to provide pressure communication between the first chamber 54 and the atmosphere. The first connection 60 enters chamber 54 close to a cover 64 of chamber 54. A second connection 66 penetrates cover 64 and is connected with controller 34.

A third connection 68 connects chamber 54 with the vacuum source through a tube 70, the second chamber 56 and a connection 72 penetrating a bottom 74 of the second chamber 56. The third connection 68 is provided with a seal 76. A spherical float body 78 in the first chamber 54 is sucked by vacuum transmitted through the third connection 68 against the lip seal 76 thus keeping the third connection 68 closed. Sphere 78 has a diameter D. The distance between the third connection 68 and plate 58 is approximately D/2. If water enters the first chamber 54, e.g. through the first connection 60, sphere 78 having a low specific weight, e.g. because sphere 78 is hollow, is lifted by buoyancy force from plate 58, and the third connection 68 is opened. Water is evacuated from the first chamber 54 through the third connection 68 towards the vacuum source. The specific weight of sphere 78 should be somewhat higher than 50% of the specific water weight so that sphere 78 is not lifted before the water level reaches the level of the third connection 68. Otherwise air would be evacuated instead of water. When the water level has dropped below the level of the third connection 68, sphere 78 has returned to its original position, touching plate 58 and sealing the third connection 68. In case that water cannot be evacuated from the first chamber 54, e.g. because there is no vacuum transmitted through the second chamber 56, float body 78 is lifted further until it closes the second connection 66 to controller 34. The second connection is provided with a seal 80. The lifted float body 78 is pressed against seal 80 so that neither air nor water can enter controller 34 through the second connection 66. When the vacuum strength recovers, water is evacuated from the first chamber 54 before controller 34 can be operated to open interface valve 36. After evacuation of water from chamber 54, atmospheric air, but no water, can enter controller 34 through the second connection 66.

A fourth connection 82 transmits air from the first chamber 54 to interface valve 36. It is connected through tube 54 with the casing of interface valve 34 and provides the interface valve with reference atmospheric air pressure. Air is sucked into the interface valve casing when interface valve 46 opens. Instead of providing the fourth connection 82, tube 54 can also be connected with tube 46, as shown in FIG. 1. The water trap 52 does not only prevent water from entering controller 34, bit also from entering the casing of interface valve 36 through tube 54.

A fifth connection 84 transmits vacuum pressure from the vacuum source through the second chamber 56 to controller 34. The fifth connection is located close to the cover plate 58 of the second chamber 56 to prevent water from entering the fifth connection. A sixth connection 72 is located in bottom 74 of the second chamber 56. Chamber 56 is connected through the sixth connection to the vacuum source. The second chamber 56 prevents wastewater that might have entered through tube 40, e.g. as a result of a pressure surge in service pipe 38, from entering the controller 34 through tube 42. Water entering through the sixth connection 72 is retained in chamber 56. This water is evacuated through the sixth connection 72 when controller 34 opens interface valve 36 and air is evacuated from interface valve 36 through tube 44, controller 34, tube 42 and tube 40.

Figure 3:
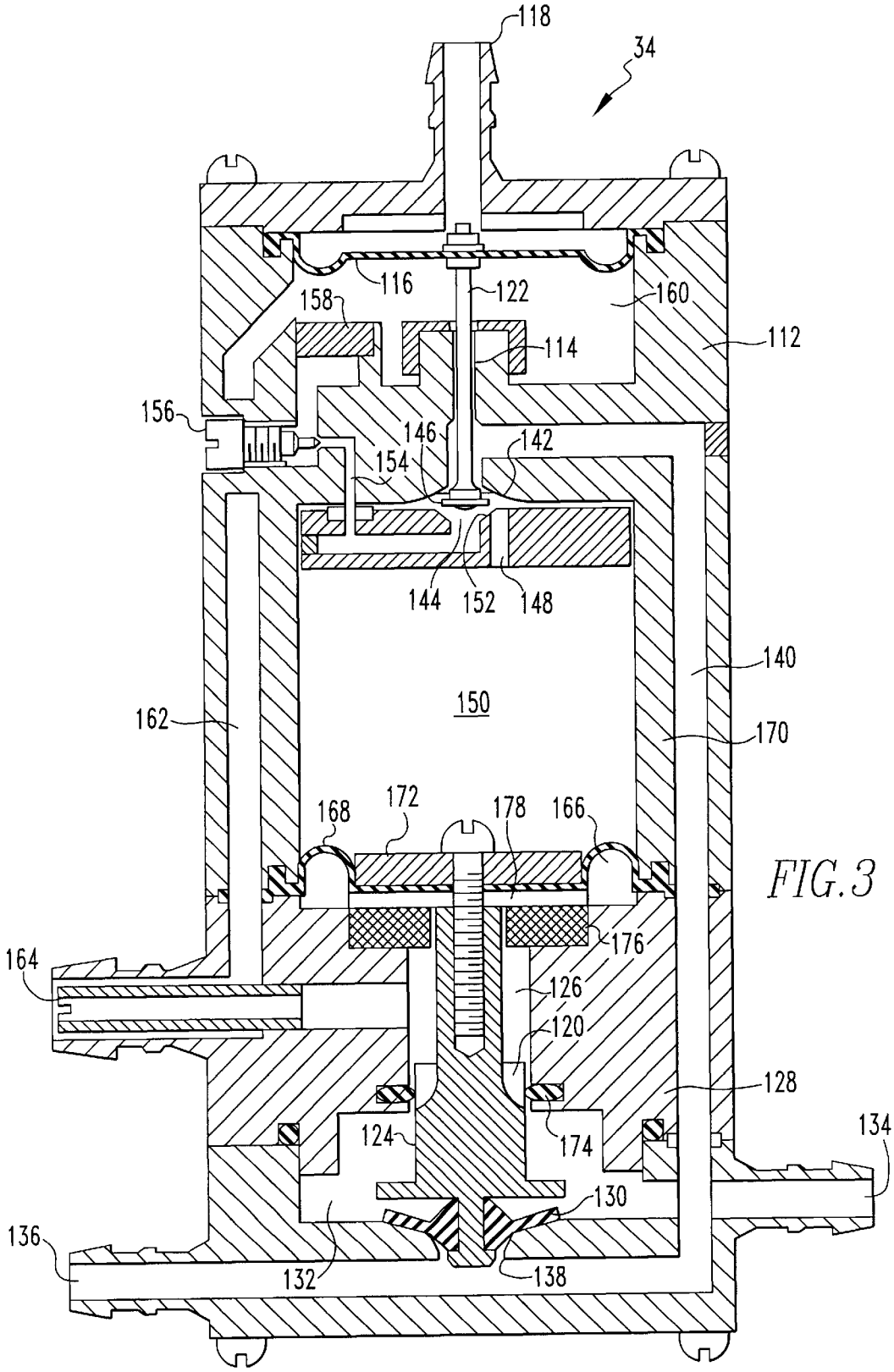
FIG. 3 shows an improved pneumatic controller in sectional view.

FIG. 3 shows the pneumatic controller 34. Controller 34 has a cylindrical casing 112 and includes a control valve 114. A sensor diaphragm 116 is moved when the sensor pressure from sensor pipe 26, transmitted through tube 32 and connection 118 of the casing 112, rises. Sensor diaphragm 116 moves operates control valve 114. The casing 112 also includes a three-way valve 120.

The valves 114 and 120 have valve pistons 122 and 124 that are moved co-axially in casing 112. The valve piston 124 of the three-way valve 120 is guided through a bore 126 through a cylindrical section 128 of casing 112. Valve piston 122 is connected with a valve disk 130 that is movable within a valve chamber 132. Valve chamber 132 has a connection 134 to tube 44 and interface valve 36.

The casing 112 has a connection 136 to tube 42 and towards the vacuum source. Vacuum is transmitted into valve chamber 132 and therefrom to the interface valve 36 when the valve disk 130 is lifted from an orifice 138. However, FIG. 3 shows the valve disk 130 in its low position, closing orifice 138 and thus preventing evacuation of the interface valve 36.

A bore 140 through casing 112 transmits vacuum to the control valve 114. Control valve 114 has a valve seat 142, a valve chamber 144 and a valve disk 146. Valve disk 146 is moveable within valve chamber 144. Valve chamber 144 has an open connection 148 to a control chamber 150. The valve disk 146 is located between valve seats 142 and another valve seat 152.

Another bore 154 through the casing 112 connects valve chamber 144 through an adjustable throttling element or nozzle 156 and a filter element 158 with another chamber 160 of casing 112. The sensor diaphragm 116 separates chamber 160 from the connection 118 to sensor tube 32 and sensor pipe 26. A further bore 162 through casing 112 connects chamber 160 to a connection 162 and through breather tube 46 to the atmosphere. Atmospheric pressure is transmitted through chamber 160 to one side of sensor diaphragm 116 while air pressure is transmitted from the sensor pipe 26 through connection 118 to the opposite side of sensor diaphragm 116. As long as the force on sensor diaphragm 116, generated by the difference between the sensor pressure and atmospheric pressure, is smaller that another force, generated by pressure difference on valve disk 144, the sensor diaphragm 116 and therewith the control valve 114 do not move. The control valve 114 remains in its first position, as shown in FIG. 3, and keeps the valve seat between bore 140 and chamber 150 shut, thus preventing evacuation of chamber 150. However, when the force exerted on sensor diaphragm 116 exceeds the force on valve disk 144, the sensor diaphragm 116 and the control valve 114 are quickly moved from a first position to a second position. In its second position the valve disk 144 closes valve seat 152 between control chamber 150 and bore 154, i.e. it interrupts pressure communication between chamber 150 and the atmosphere. Instant switching of the control valve 114 from its first to its second position is guaranteed by the effect, that the vacuum force exerted on valve disk 144 instantly breaks down when valve disk 144 is removed from valve seat 142. In addition, the valve disk 144 has an upper and a lower elastic seal lip. The lower lip seals valve seat 152 before the upper lip is removed from valve seat 142. Flow of air from bore 146 to bore 140 is always prevented.

The control valve 114 is a switch valve. It connects the control chamber 150 either through connection 164 with the atmosphere, in its first position, or through connection 136 with the vacuum source, in its second position. Control valve 114 thus prevents open connection between atmosphere and vacuum source, and prevents continuous flow of air from the atmosphere through controller 34 to the vacuum source. It thus prevents evacuation of sump top 48 through controller 34, and prevents wastewater in sump 12 from rising to sump breather line 50. It thus prevents entrance of wastewater into controller 34.

Atmospheric pressure is not only transmitted through connection 164 and bore 162 to chamber 160, but also through the bore 126 to another chamber 166 that is separated by a control diaphragm 168 from the control chamber 150. The control diaphragm 168 is peripherally fixed to casing 112 or, more specifically, to a wall 170 of control chamber 150. The control diaphragm 168 is centrally attached to a plate 172. Plate 172 is itself fixed to the piston 124 of the three-way valve 120. The control diaphragm 168 can be moved by a pressure difference between chamber 166 and control chamber 150. Such a pressure difference is generated when the control chamber 150 is evacuated through the control valve 114. Control diaphragm 168 is pulled towards control chamber 150. The three-way valve 120, piston 124 and valve disk 130 are also moved upwards. The valve piston 124 is pressed against a seal 174 sealing a gap between bore 126 and valve chamber 132 and interrupting pressure communication between the atmosphere and the interface valve 36 through connection 164 and connection 134. With a slight delay valve seat 174 is lifted from valve seat 138 thus opening pressure communication between the vacuum source and the interface valve 36 through connection 136 and connection 134. Interface valve 36 is evacuated and opened. Wastewater is evacuated from sump 12 through the open interface valve 36 towards the vacuum source.

Communication between atmosphere and interface valve 36 is interrupted before communication between the vacuum source and the interface valve 36 is opened. Flow of atmospheric air from connection 164 to connection 136 is prevented. Evacuation of the sump top 48 is thus prevented.

Latching means are provided to prevent opening of interface valve 36 while the vacuum strength is insufficient for proper evacuation of wastewater from sump 12, and to guarantee instant switching of the three-way valve 120. The latching means prevent upwards movement of the three-way valve 120 unless a, strong vacuum is transmitted into the control chamber 150. The latching means can be a mechanical mechanism, e.g. including spring and catch elements as shown in U.S. Pat. No. 5,657,784, incorporated by reference herein, or consist of a magnet 176 fixed to the casing 112 and a metal plate 178 fixed to the plate 172. The three-way valve 120 can move upwards only when the force on control diaphragm 168, exerted by the difference between atmospheric pressure in chamber 166 and vacuum pressure in control chamber 150, exceeds the sum of the latching force between the magnet 176 and the metal plate 178 and of the force exerted by pressure difference on valve disk 130. When the vacuum strength in chamber 150 is sufficiently strong, the three-way valve pops up.

While the three-way valve 120 switches and interface valve 36 is evacuated, a small volume of atmospheric air enters from sump top 48 through breather line 50 and connection 164 into the enlarging chamber 166. Another small volume of air flows from sump top 48 through breather line 50 and breather tube 54 into the casing of interface valve 36. These air volumes are only a very small fraction of the air volume present in sump top 48. Rise of water level 28 is insignificant and wastewater cannot reach sump breather line 50.

While wastewater is evacuated from sump 12, water level 28 and sensor pressure in sensor pipe 26 drop. Sensor diaphragm 116 has now atmospheric pressure on both sides and returns to its original position because it is driven upwards by a pressure difference exerted on the valve disk 146 of the control valve 114. Upward movement can be assisted by a spring (not shown in FIG. 3, but shown in U.S. Pat. No. 5,657,784) between casing 112 and sensor diaphragm 116. Control valve 114 shuts pressure communication between the vacuum source and control chamber 150 through connection 136 and bore 140 before it opens pressure communication between the atmosphere and control chamber 150 through connection 164. Only a very small air volume flows from sump top 48 through breather line 50 and connection 164 into control chamber 150. This air volume is smaller than the volume of control chamber 150.

The nozzle 156 with an adjustable and small orifice restricts the flow of air into control chamber 150. The pressure in control chamber 150 rises gradually and the three-way valve 120 moves slowly downward. Air also flows from chamber 166 through bore 160, bore 162, chamber 160, filter element 158, nozzle 156, bore 154 and valve chamber 152 into control chamber 150 thus reducing the air flow through breather line 50. The three-way valve 120 is moved by the pressure difference exerted on piston 124. A spring (not shown in FIG. 3, but shown in U.S. Pat. No. 5,657,784) can assist downward movement. Air is admitted to the vacuum system through vent stack 22, sump 12, the still open interface valve 36 and service pipe 38. The adjustable nozzle 156 controls the velocity of the movement of the three-way valve 120 and therewith the volume of admitted air.

As the metal plate 178 approaches magnet 176, movement of the three-way valve is accelerated by magnetic force. Valve disk 130 seals valve seat 138 and interrupts communication between connection 136 and connection 134 before the valve piston 124 is removed from seal 174 thus opening communication between connection 164 and connection 134. Flow from atmospheric connection 164 to vacuum connection 136 is prevented. While the interface valve 36 shuts, air flows from its casing through tube 54, connections 164 and 134 and tube 44 to interface valve 36 thus reducing flow through breather line 50. When interface valve 36 has shut, an evacuation cycle is finished.

The volume of the air flowing through the nozzle 156 into control chamber 150 during an evacuation cycle is only a fraction of the volume of control chamber 150, the fraction depending on the vacuum pressure. The fraction is e.g. only about 20% if the vacuum pressure is 20 kPa. The control chamber has a typical volume below 0.15 liters.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An arrangement in a vacuum sewer system comprising: a sump for collection of wastewater; an interface valve for evacuation of wastewater from the sump; a pneumatic controller to control opening and closing of the interface valve, the pneumatic controller being pneumatically connected to atmospheric air through a breather line, to a vacuum source and to the interface valve, the arrangement preventing entrance of water into the controller through the breather line, the pneumatic controller including means preventing any open connection from the breather through the controller line to the vacuum source thus preventing continuous flow of atmospheric air from the breather line and the controller to the vacuum source, the means preventing open connection include a control chamber and a control valve, the control valve switching between a first and a second position, in its first position closing a first connection between the control chamber and the vacuum source, and in its second position closing a second connection between the control chamber and the breather line.

2. An arrangement as described in claim 1 whereby the control valve closes the second connection between the control chamber and the breather line before it opens the first connection between the control chamber and the vacuum source when the control valve is switched from its first to its second position.

3. An arrangement as described in claim 2 whereby the control valve comprises a valve disk with a first peripheral elastic sealing lip on one side and a second peripheral sealing lip on another side, a first valve seat at the first connection and a second valve seat at the second connection, the second lip touching the second valve seat before the first lip is removed from the first valve seat when the control valve is switched from its first to its second position.

4. An arrangement as described in claim 1 whereby the controller includes:

a control valve that is moved from a first to a second position by movement of a sensor diaphragm when wastewater has been collected in the sump, and returns from the second to the first position when the wastewater is evacuated from the sump;

a control chamber with a first connection to the vacuum source that is closed by the control valve in its first position and open when the control valve is in its second position, and a second connection to the breather line that is open when the control valve is in its first condition and closed when the control valve is in its second condition;

a movable control diaphragm that is peripherally connected to a wall of the control chamber, one side of the diaphragm being in communication with the control chamber, the opposite side of the diaphragm being in communication with the breather line, the control diaphragm being pulled into the control chamber when the control chamber is evacuated through the control valve while the control valve is in its second condition, and the diaphragm being returned when atmospheric air enters the control chamber after the control valve has returned to its first position; and a three-way valve that is moved by the control diaphragm and has a first position closing a third connection between the interface valve and vacuum source and a second position closing a fourth connection between the interface valve and the breather line, the three-way valve switching from its first position to its second position when the control diaphragm is pulled into the control chamber and returning from its second to its first position when the control diaphragm returns, whereby the fourth connection is closed before the third connection is opened when the three-way valve switches from its first to its second position.

5. An arrangement as described in claim 4 whereby the sensor diaphragm is on one side in pressure communication with a sensor pipe and on another side in pressure communication with the breather line.

6. An arrangement as described in claim 4 whereby the controller has a casing including latching means, the latching means exerting a latching force between the casing and the control diaphragm, the latching force preventing movement of the three-way valve from its first to its second position until a sufficiently strong vacuum in the control chamber overcomes the latching force.

7. An arrangement as described in claim 4 whereby one side of the control diaphragm is directed towards the control chamber and another side of the control diaphragm is in pressure communication with the breather line.

8. An arrangement as described in claim 1 whereby an adjustable nozzle is provided between the second connection of the control chamber and the breather line, the nozzle restricting flow of atmospheric air from the breather line into the control chamber when the control valve is in its first position.

9. An arrangement as described in claim 8 whereby a filter element is provided between the nozzle and the breather line.

10. An arrangement in a vacuum sewer system comprising: a sump for collection of wastewater; an interface valve for evacuation of wastewater from the sump, a pneumatic controller to control opening and closing of the interface valve, the controller including a control chamber, the pneumatic controller being pneumatically connected to atmospheric air through a breather line, to a vacuum source and to the interface valve; the arrangement preventing entrance of water into the controller through the breather line, including a first chamber connected to the breather line, the first chamber having a bottom, a cover and a wall, a first connection to the breather line for the supply of atmospheric air, a second connection to the controller, and a third connection to the vacuum source, and a float body within the first chamber, the float body closing and sealing the third connection when the float body rests on the bottom and opening the third connection when the float body is lifted by buoyancy force from the bottom.

11. An arrangement as described in claim 10 whereby the float body closes and seals the second connection when the float body is lifted by buoyancy force to the cover.

12. An arrangement as described in claim 10 whereby the first connection is located in the wall of the first chamber near the cover.

13. An arrangement as described in claim 10 whereby the first chamber has a fourth connection to the interface valve.

14. An arrangement as described in claim 13 including a fifth connection to the controller, and a sixth connection to the vacuum source, whereby the third connection is connecting the first chamber with a second chamber, the second chamber having a bottom, wall and cover.

15. An arrangement as described in claim 14 whereby the first chamber and the second chamber are enclosed by a single cylindrical housing.

16. An arrangement as described in claim 14 whereby the sixth connection is located at the bottom of the second chamber.

17. An arrangement as described in claim 14 whereby the fifth connection is located in the wall and near the cover of the second chamber.

18. An arrangement as described in claim 14 whereby the cover of the second chamber is the bottom of the first chamber.

19. An arrangement as described in claim 14 whereby the second chamber has a cylindrical shape.

20. An arrangement as described in claim 10 whereby the second connection is connected to the controller and the interface valve.

21. An arrangement as described in claim 10 whereby the third connection is provided with a lip seal.

22. An arrangement as described in claim 10 whereby the third connection penetrates the wall of the first chamber.

23. An arrangement as described in claim 10 whereby the float body is a sphere with a diameter D.

24. An arrangement as described in claim 23 whereby the first connection and the fourth connection have distances from the cover of the first chamber smaller than D/2.

25. An arrangement as described in claim 23 whereby the first chamber has a height that is smaller than twice the diameter D of the sphere.

26. An arrangement as described in claim 23 whereby the first chamber has a width smaller than 1.5*D.

27. An arrangement as described in claim 10 whereby the first chamber has a cylindrical shape.

28. An arrangement as described in claim 10 whereby the bottom of the first chamber is sloped towards the third connection.

29. An arrangement as described in claim 10 whereby the wall of the first chamber is a section of a plastic pipe and the cover of the first chamber is a plastic pipe cap.

30. An arrangement as described in claim 10 whereby the cover of the first chamber is removable from the wall of the first chamber.

31. An arrangement as described in claim 10 whereby a check valve is provided between the third connection and the vacuum source.

32. An arrangement as described in claim 10 whereby the first chamber has a greater volume than the control chamber of the controller.

33. An arrangement as described in claim 10 whereby the first chamber has a greater volume than a pneumatic actuator of the interface valve.

34. A method for controlling an interface valve of a vacuum sewer system evacuating wastewater from a sump to a vacuum source and preventing water from entering the controller through a breather line, comprising the steps of:

moving a sensor diaphragm by an increasing sensor pressure transmitted to the sensor diaphragm from the sump;

switching a control valve from a first to a second position by the movement of the sensor diaphragm;

closing a second connection between a control chamber and the breather line and thereafter opening a first connection between the control chamber and the vacuum source while the control valve switches from its first to its second position;

evacuating the control chamber through the open first connection and reducing the pressure in the control chamber;

pulling a control diaphragm into the control chamber by decreasing pressure in the control chamber;

switching a three-way valve from a first to a second position by movement of the control diaphragm;

closing a third connection between the interface valve and the breather line and thereafter opening a fourth connection between the interface valve and the vacuum source while the three-way valve is moved from its first to its second position by movement of the control diaphragm;

evacuating and opening the interface valve through the now open fourth connection;

evacuating wastewater from the sump valve to the vacuum source through the now open interface;

returning the sensor diaphragm by decreasing sensor pressure when the sump is evacuated;

returning the control valve from its second to its first position by return of the sensor diaphragm;

closing the first connection between the control chamber and the vacuum source and thereafter opening the second connection between the control chamber and the breather line;

ventilating the control chamber through the breather line and the now open second connection;

returning the control diaphragm out of the control chamber by rising pressure in the control chamber;

returning the three-way valve from its second to its first position by movement of the control diaphragm;

closing the fourth connection between the interface valve and the vacuum source and thereafter opening the third connection between the interface valve and the atmosphere by returning the three-way valve; and closing the interface valve by ventilating the interface valve through the breather line and the now open fourth connection.

* * * * *